US007118187B2

(12) United States Patent
Arakawa

(10) Patent No.: US 7,118,187 B2
(45) Date of Patent: Oct. 10, 2006

(54) INKJET RECORDING APPARATUS HAVING AN ADJUSTING MECHANISM FOR ADJUSTING MOVING OF A RECORDING MEDIUM

(75) Inventor: Hiroaki Arakawa, Uenohara-machi (JP)

(73) Assignee: Konica Minolta Holdings, Inc., Tokyo (JP)

( * ) Notice: Subject to any disclaimer, the term of this patent is extended or adjusted under 35 U.S.C. 154(b) by 213 days.

(21) Appl. No.: 10/682,318

(22) Filed: Oct. 9, 2003

(65) Prior Publication Data

US 2004/0075708 A1 Apr. 22, 2004

(30) Foreign Application Priority Data

Oct. 18, 2002 (JP) ..... 2002-304279
May 12, 2003 (JP) ..... 2003-133496

(51) Int. Cl.
*B41J 29/393* (2006.01)

(52) U.S. Cl. ..... 347/19

(58) Field of Classification Search ..... 347/19, 347/16, 104, 15
See application file for complete search history.

(56) References Cited

U.S. PATENT DOCUMENTS 4,734,868 A * 3/1988 DeLacy ..... 358/1.12
4,839,674 A * 6/1989 Hanagata et al. ..... 346/136
5,539,434 A * 7/1996 Fuse ..... 347/19
5,627,571 A * 5/1997 Anderson et al. ..... 347/19
5,777,638 A * 7/1998 Salter et al. ..... 347/12
6,158,344 A * 12/2000 Walker et al. ..... 101/484
6,241,334 B1 * 6/2001 Haselby ..... 347/19
6,302,510 B1 * 10/2001 Yoshida ..... 347/19
6,315,382 B1 * 11/2001 Gudaitis et al. ..... 347/19
6,352,331 B1 * 3/2002 Armijo et al. ..... 347/19
6,386,671 B1 * 5/2002 Huston et al. ..... 347/16
6,412,909 B1 * 7/2002 Tayuki et al. ..... 347/41
6,425,650 B1 * 7/2002 Walker et al. ..... 347/14
6,547,355 B1 * 4/2003 Shimada et al. ..... 347/12
6,663,206 B1 * 12/2003 Taylor ..... 347/9
6,775,022 B1 * 8/2004 Noyes et al. ..... 358/1.15
6,900,449 B1 * 5/2005 Bolash et al. ..... 250/559.16
2002/0012027 A1 * 1/2002 Moon et al. ..... 347/64

FOREIGN PATENT DOCUMENTS

JP 59-171664 A 9/1984
JP 03-042264 A 2/1991
JP 4-19149 A 1/1992

(Continued)

OTHER PUBLICATIONS

Related U.S. Appl. No. 10/910,527; filed: Aug. 3, 2004; Inventors: Hiroaki Arakawa et al; Title: Inkjet Recording Apparatus and Recording Medium Movement Control Mechanism.

*Primary Examiner*—Manish S. Shah
*Assistant Examiner*—Laura E. Martin
(74) *Attorney, Agent, or Firm*—Frishauf, Holtz, Goodman & Chick, P.C.

(57) ABSTRACT

An inkjet recording apparatus having therein:
a recording head,
a recording head moving device,
a recording medium feeding device,
a mark recording device to print a predetermined mark on the recording medium by ejecting ink droplets, and
a mark detecting device to detect the mark printed by the mark recording device, arranged at a predetermined distance position from the recording medium, and is fed together with the recording head,
wherein the movement amount of the recording medium is determined on the basis of the position where the mark detecting device detects detection signals.

1 Claim, 9 Drawing Sheets

FOREIGN PATENT DOCUMENTS

JP 11-334160 A 12/1999

JP 2000-218891 A 8/2000

* cited by examiner

INKJET RECORDING APPARATUS HAVING AN ADJUSTING MECHANISM FOR ADJUSTING MOVING OF A RECORDING MEDIUM

BACKGROUND OF THE INVENTION

The present invention relates to an inkjet recording apparatus, and in particular, to an inkjet recording apparatus in which a feeding accuracy of a recording medium in a sub-scanning direction is improved.

In an inkjet recording apparatus for recording desired images by ejecting ink droplets on the recording medium, the recording head for ejecting the ink droplets is moved above the recording medium in the main scanning direction, and thereafter the recording head, with respect to each line recording, is repeatedly moved, in the sub-scanning direction, which is perpendicular to the main scanning direction.

Heretofore, the movement of the recording medium in the sub-scanning direction was generally achieved by the intermittent feeding operation of a stepping motor, or by a DC motor having a rotary encoder. In the former case, when one line is recorded by the recording head in the main scanning direction, the predetermined number of pulses is applied to the stepping motor, and this number of pulses becomes the feeding distance, which is the predetermined length (patent document 1) to feed the recording medium in the sub feeding direction. While in the latter case, feeding of the recording medium in the sub-scanning direction is read from the counted number of pulses generated by the rotary encoder, and thereby the movement of the recording medium is controlled by the counted number of pulses by which the predetermined feeding amount can be obtained. (patent document 2).

Further, there is a case wherein the rotary encoder is installed on a rotating shaft of a feeding roller which feeds the recording medium in the sub-scanning direction, and therefore the feeding amount is controlled by the counted number of pulses (patent document 3).

[patent document 1] Tokkaihei 11-334160

[patent document 2] Tokkaisyou 59-171664

[patent document 3] Tokkaihei 4-19149

In recent years, in order to record the images with extended definition at a high speed, the number of the nozzles of the recording head was increased, as was the length of the nozzle array of the recording head, and since the length of the recording head in the sub-scanning direction increased, it essentially required the improvement of the feeding accuracy. For example, recently researched was an image recording method to obtain extended definition images having no banding, by printing the images by each block. Such a recording method requires a greater feeding distance of the recording medium in the sub-scanning direction at one time, therefore, a dramatic increase of feeding accuracy is essential, which however has not been used practically.

Because, the feeding amount of the recording medium on the inkjet recording apparatus is indirectly affected by only counting the pulses of the stepping motor to drive a feeding roller of the recording medium, or the pulses generated by the rotary encoder, and thereby errors occur in the practice in the fed amount of recording medium, which in turn causes a white band between each block of printing, deteriorating the image quality.

That is, whichever device may be used the stepping motor or the DC servo motor integrated with the rotary encoder, the feeding amount of the recording medium which is obtained by the counted number of pulses, does not show the real fed amount, owing to factors such as errors of diameter of the feeding roller and the shaft center position of the feeding roller, the difference between the thickness of the recording media, and the slip generated between the feeding roller and the recording medium, resulting in errors of the real fed amount of the recording medium, and thereby generating white bands. Such a problem may be solved by installing the rotary encoder on the rotating shaft of the feeding roller, this however does not obtain sufficient improvement when the feeding distance increases.

SUMMARY OF THE INVENTION

The objective of the present invention is to provide an inkjet recording apparatus which can feed the recording medium very precisely, even when the feeding distance in the sub-scanning direction of the recording medium is increased greatly.

The other objectives of the present invention will be clarified by the following descriptions.

The above objective is solved by the following structures.

Structure 1

An inkjet recording apparatus having therein:

a recording head to eject ink droplets from a plurality of nozzles onto a recording medium;

a recording head moving device to move the recording head in the main scanning direction (that is, perpendicular to a feeding direction of the recording medium);

a recording medium feeding device to feed the recording medium on a platen in the sub-scanning direction (that is, the feeding direction of the recording medium);

a mark recording device to record a predetermined mark on the recording medium by ejecting the ink droplets from at least any one of the nozzles, while the recording head is moved by the recording head moving device; and a mark detecting device to detect the mark recorded by the mark recording device, the mark detecting device which is arranged at a predetermined distance position from the recording medium, and is moved together with the recording head by the recording head moving device;

wherein the feeding amount of the recording medium forced by the recording medium feeding device is determined on the basis of the position on which the mark detecting device detects the mark (a detecting signal of the mark).

Structure 2

The inkjet recording apparatus described in structure 1, wherein the recording medium feeding device feeds the recording medium at a high speed to a position which is adjacent to the position where the mark is detected by the mark detecting device, and further feeds the recording medium at a low speed from the position adjacent to the mark.

Structure 3

The inkjet recording apparatus described in structure 1 or 2, further having:

A memory device to store the feeding amount of the recording medium, wherein when the mark detecting device can not detect the mark as it normally does, the recording medium is fed on the basis of the previous feeding amount stored in the memory device.

Structure 4

The inkjet recording apparatus described in structure 1, 2 or 3, wherein the feeding distance of the recording medium in the sub-scanning direction until the mark detecting device detects the aforementioned mark, is less than the feeding amount which the recording medium must advance fundamentally in the sub-scanning direction.

Structure 5

The inkjet recording apparatus described in any one of structures 1–4, further having:

a feeding amount detecting device which detects the feeding amount of the recording medium, wherein the recording medium feeding device has a changeover device which can switch to a case in which the feeding amount of the recording medium is determined on the basis of the position where the mark detecting device detects the detection signal, or another case in which the feeding amount of the recording medium is determined on the basis of only the detection signal from the feeding amount detecting device.

Structure 6

The inkjet recording apparatus described in any one of structures 1–5, wherein the mark detecting device works for both The recording medium detecting device which detects whether or not the recording medium exists, and/or a bi-directional position detecting device which performs bi-directional positioning of the recording head in relation to the recording medium.

Structure 7

The inkjet recording apparatus described in any one of structures 1–6, wherein the mark recording device records a plurality of marks at a time, on the recording medium by the ink droplets ejected from a plurality of the different nozzles, the mark detecting device detects any one of the plurality of marks, the recording medium feeding device calculates and assumes a position which gives the smallest detection error from the distance interval calculated by the nozzle pitch of the recording head, referring to the position of each mark detected by the mark detecting device, and the feeding amount is determined on the basis of a standard position (that is, the calculated and assumed position).

Structure 8

The inkjet recording apparatus described in any one of structures 1–7, wherein the mark is printed at the point located outside the image printing area.

Structure 9

The inkjet recording apparatus described in any one of structures 1–7, wherein the mark is recorded on an area which is, in the recording medium feeding direction, upstream of the area on which the main scanning of the recording head performs the printing.

Structure 10

The inkjet recording apparatus described in structure 9, wherein the recording head is composed of a plurality of heads, and among the plurality of these heads, the head which has the nozzle for printing the predetermined mark on the recording medium by ejecting ink droplets, is shifted for one nozzle interval from the other heads, in the recording medium feeding direction.

Structure 11

The inkjet recording apparatus described in structure 10, wherein the mark recording device allows the mark printing nozzle to eject ink for a distance necessary for printing the mark in the scanning direction.

Structure 12

The inkjet recording apparatus described in structure 10 or 11, wherein the mark recording device prevents a nozzle adjacent to the mark recording nozzle from ejecting ink.

Structure 13

The inkjet recording apparatus described in any one of structures 1–12, wherein the mark detecting device is composed of a light reflection type sensor, having at least:

a light emitting element which emits detecting light onto the recording medium;

a condenser lens which condenses the detecting light emitted from the light emitting element; and a light receiving sensor which detects light reflected from the surface of the recording medium on which the detecting light is focused by the condenser lens, wherein the light emitting element and the optical axis of the condenser lens are angled to the surface of the recording medium in the main scanning direction.

Structure 14

The inkjet recording apparatus described in any one of structures 1–12, wherein the mark detecting device is composed of a reflection type sensor, having at least:

a light emitting element which emits a detecting light beam onto the recording medium;

a condenser lens which focuses the detecting light beam emitted from the light emitting element; and a light receiving sensor which detects the light beam reflected from the surface of the recording medium on which the detecting light beam is focused by the condenser lens, wherein the light emitting element and the optical axis of the condenser lens are approximately perpendicular to the surface of the recording medium.

Structure 15

The inkjet recording apparatus described in structure 7, wherein the mark detecting device is composed of a light reflection type sensor, having at least:

a light emitting element which emits the detecting light beam onto the recording medium;

a condenser lens which condenses the detecting light beam emitted from the light emitting element; and a light receiving sensor which detects the light beam reflected from the surface of the recording medium on which the detecting light beam is focused by the condenser lens, wherein the light emitting element and the optical axis of the condenser lens are approximately perpendicular to the surface of the recording medium, and wherein the light emitting element, condenser lens and the recording medium are arranged, satisfying the inequality $k \times b < a \times m$, where "k" is the length of the light emitting element in the sub-scanning direction, "a" is the distance between the condenser lens and the surface of the recording medium, and "b" is the pitch width in the sub-scanning direction.

Structure 16

The inkjet recording apparatus described in any one of structures 1–15, wherein the mark is yellow.

Structure 17

The inkjet recording apparatus described in structure 16, wherein the light emitting element is a blue LED, and the light detecting element is sensitive to blue.

Structure 18

The inkjet recording apparatus described in any one of structures 1–17, wherein the mark is a short straight line in the main scanning direction.

DESCRIPTION OF THE PREFERRED EMBODIMENTS

Figure 1:
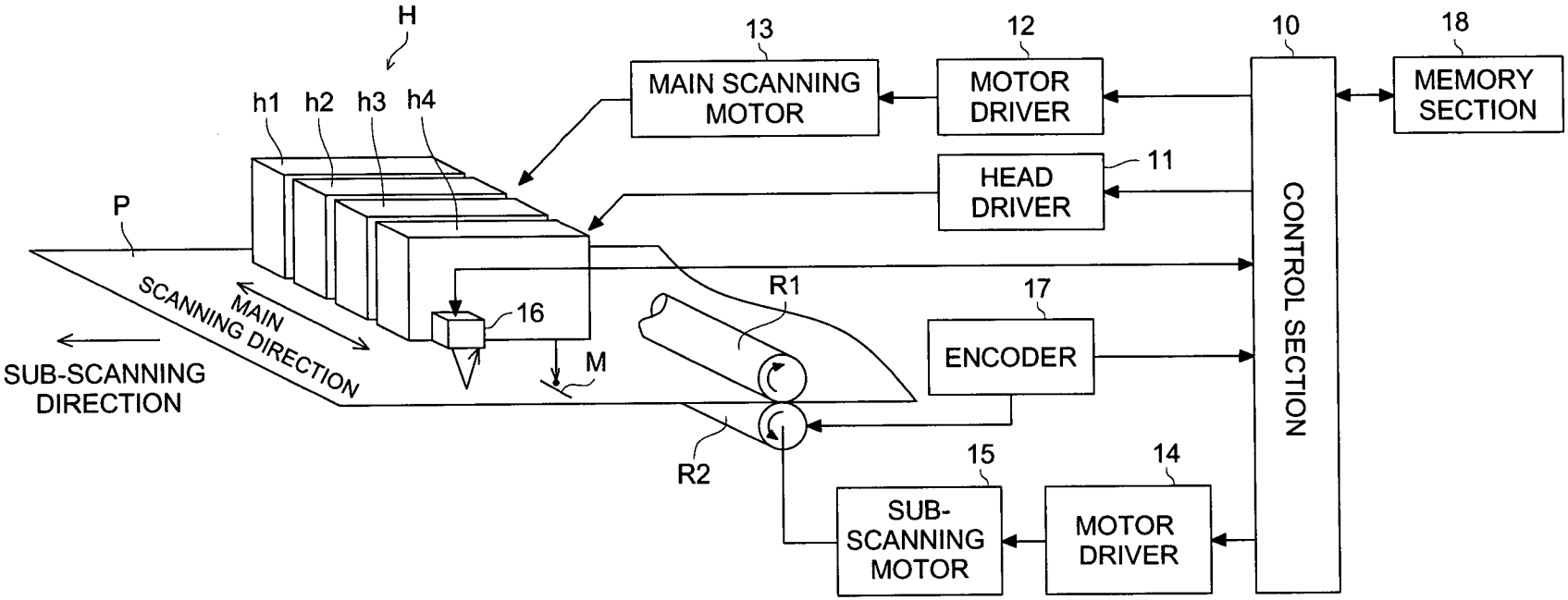
FIG. 1 is a schematic drawing showing the general outline of the inkjet recording apparatus relating to the present invention.
Figure 2:
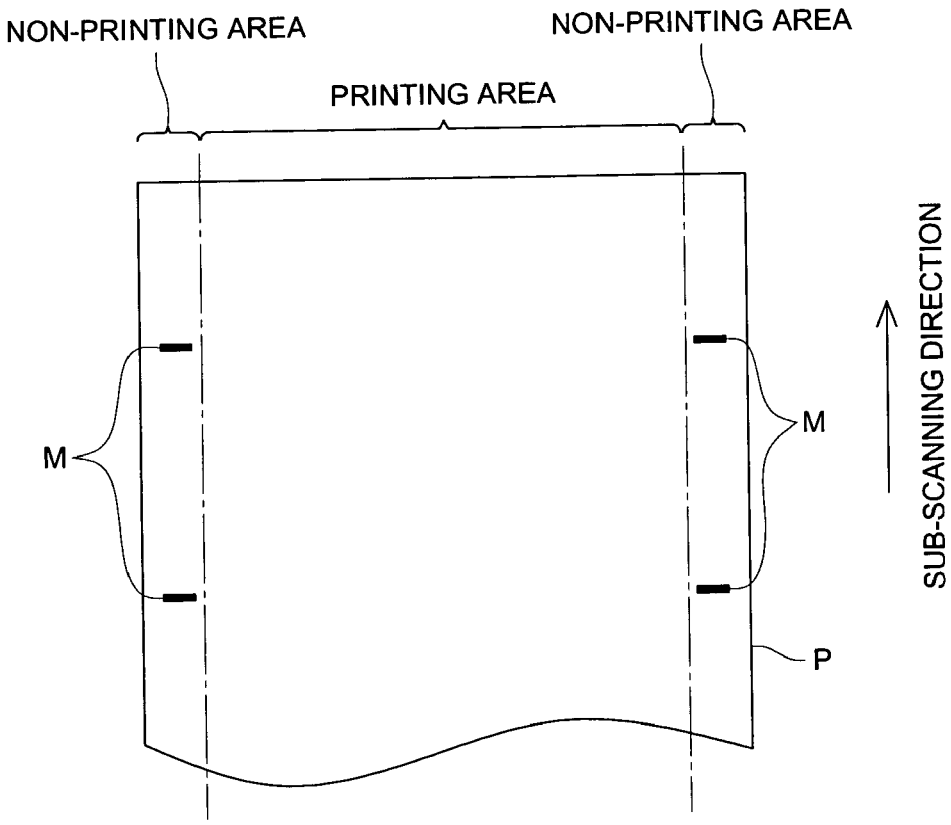
FIG. 2 is a drawing showing the position of the mark printed on the recording medium.

The various embodiments of the invention will be described in detail, while referring to the drawings.

FIG. 1 is a structural drawing showing the general outline of the inkjet recording apparatus relating to the present invention. In FIG. 1, symbol H is a recording head, which is composed of four heads h1–h4, corresponding to four colors Y, M, C and B. However, the number of the heads in recording head H is not limited to four.

Numerous nozzles (not illustrated) are aligned in one line perpendicular to the main scanning direction of recording head H on the undersurfaces of each head h1–h4. Control section 10, installed in the inkjet recording apparatus main body, controls head driver 11 to eject the small ink droplets, which are formed from liquid ink, downward in the case of FIG. 1, from each nozzle of each head h1–h4 at predetermined timing, and thereby the desired image is formed on recording medium P.

Recording head H is installed on a carriage (not illustrated), and motor driver 12 which is controlled by control section 10, activates main scanning motor 13, which drives united heads h1–h4, bi-directionally in the main scanning direction. In the present embodiment, the recording head moving device is composed of control section 10, motor driver 12, and main scanning motor 13.

Recording medium P is nipped by paired feeding rollers R1 and R2 which are driven by sub-scanning motor 15, and motor driver 14 controlled by controller 10 drives sub-scanning motor 15, and thereby recording medium P is fed intermittently with the predetermined amount in the sub-scanning direction (left direction in FIG. 1) perpendicular to the scanning direction of recording head H. In the present embodiment, the recording medium feeding device of the present invention is composed of control section 10, motor driver 14, sub-scanning motor 13, and feeding rollers R1 and R2.

In the inkjet recording apparatus relating to the present invention, in the procedure of driving the recording head moving device in the main scanning direction, control section 10 controls head driver 11 to eject the ink droplets from at least one of the nozzles, and therefore prints predetermined mark M on recording medium P. Accordingly in the present embodiment, the mark recording device is composed of control section 10, head driver 11, and recording head H, as explained above.

Any pattern will be acceptable as mark M, if only mark M, printed on recording medium P, can be produced by the droplets ejected from the nozzle, while recording head H moves in the main scanning direction, and which further can be detected by the later-mentioned mark detecting device, however, in this embodiment, mark M is printed as a short straight line having a constant length (1.0 mm, for example) in the main scanning direction. When Mark M is such a line as mentioned above, mark M can be easily printed in only one scan of recording head H. Further, the mark detecting device mentioned later can precisely detect it, and thereby recording medium P can be fed very precisely.

Still further, in the case that recording head H is composed of plural heads h1–h4 as shown in the present embodiment, the head for printing mark M can be any one of the heads (h4 for example), and the nozzle for ejecting the ink droplets can be any one of nozzles of that head.

When plural colored inks in the plural heads are used for image recording, the color of mark M is preferably yellow, because a yellow mark M is barely visible on recording medium P. Still further, for plural heads which can eject both dark ink and light ink, the light yellow ink is still less visible and more preferable.

When the apparatus produces a bordered print, which means a print having margin areas on the edges parallel to the sub-scanning direction of recording medium P, and on which images are not printed, it is preferable that mark M is printed on this margin area, that is, the non-printing area. In this case, though it is possible to print mark M on either or both non-printing areas existing at the sides of the sheet, it is also possible to print mark M on any of the non-printing areas, and more specifically, it is preferable to print mark M on the non-printing area existing at the side which the after-mentioned mark detecting device faces and is installed on.

As shown in FIG. 1, optical sensor 16, representing the mark detecting device of the present invention, is provided on either of the sides of recording head H which are parallel to the main scanning direction of recording head H.

Figure 3:
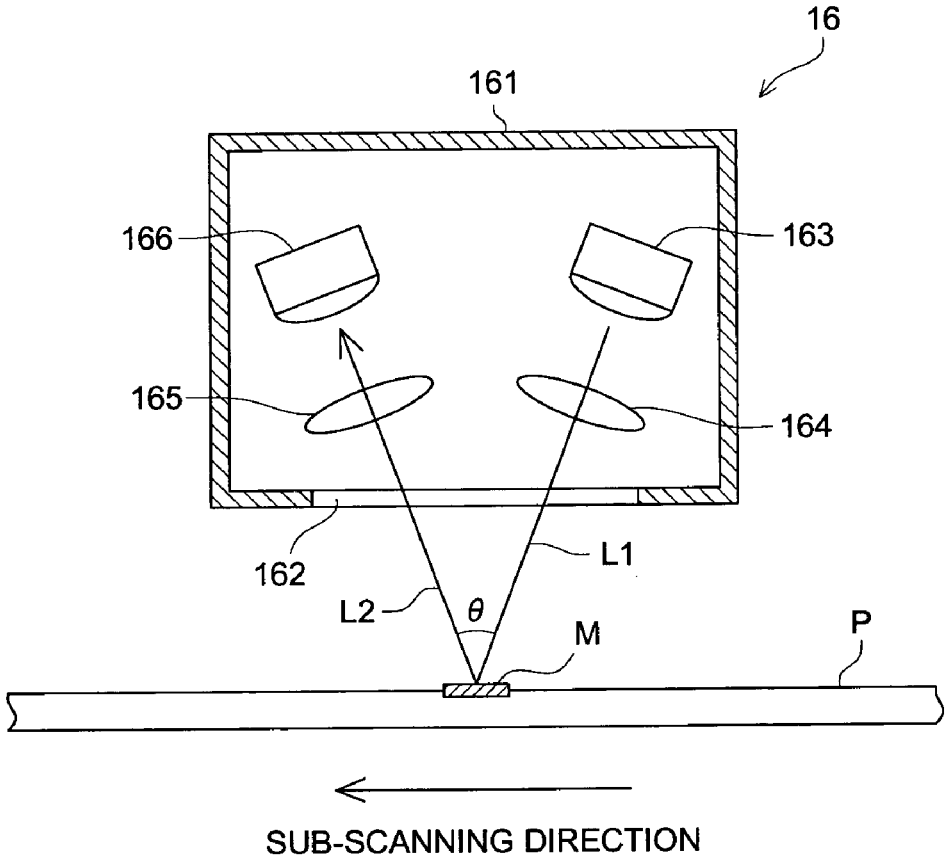
FIG. 3 is a drawing showing the structure of the mark detecting device.

As shown in FIG. 3, optical sensor 16 is a sensor having in housing 161:

light emission element 163 which radiates the detecting light at an angle to the surface of recording medium P through opening 162;

condenser lens 164 which focuses the detecting light rays onto the surface of recording medium P;

condenser lens 165 which condenses light rays reflected from recording medium P, and light receiving element 166 which receives light rays focused by condenser lens 165;

wherein when optical sensor 16 detects a change of the amount of light rays, that is, when mark M on recording medium P passes under the detecting light rays radiated onto recording medium, mark M was detected.

The output signal from optical sensor 16 is inputted into control section 10, and control section 10 determines whether or not mark M was detected.

In order to assuredly detect mark M, when mark M is printed in yellow ink, blue LED (wavelength 460 nm–500 nm) is preferably used for light emitting element 163 in optical sensor 16, while preferably used is the light receiving element sensitive to blue light, that is, a light receiving element sensitive to the wavelength which is emitted from a blue LED, for light receiving element 166. Generally a photo-sensor is used for the light receiving element 166 mentioned above.

It is preferable that optical sensor 16, being the mark detecting means, also functions as a sensor for the recording medium detecting means which detects the presence of recording medium P, that is, whether recording medium P arrives at the position where recording head H conducts the recording. By employing optical sensor 16 which functions not only as the mark detecting means but also as the recording medium detecting means, it is possible to reduce the number of parts, and also to reduce production cost.

Further, it is preferable that optical sensor 16 also functions as a sensor for the bi-directional position detecting means which conducts the bi-directional positioning of recording head H in relationship to recording medium P. That is, when recording head H moves along the main scanning direction, optical sensor 16 detects the position of both edges of recording medium P, and thereby the bi-directional positioning of recording head H is performed. By using optical sensor 16 also for this purpose, it is possible to still further reduce the number of parts, and to reduce production cost.

Obviously, it is preferable that optical sensor 16 functions not only as a sensor for the above-mentioned recording medium detecting means but also as a sensor the above-mentioned bi-directional position detecting means, by which the number of parts is further reduced.

Figure 7:
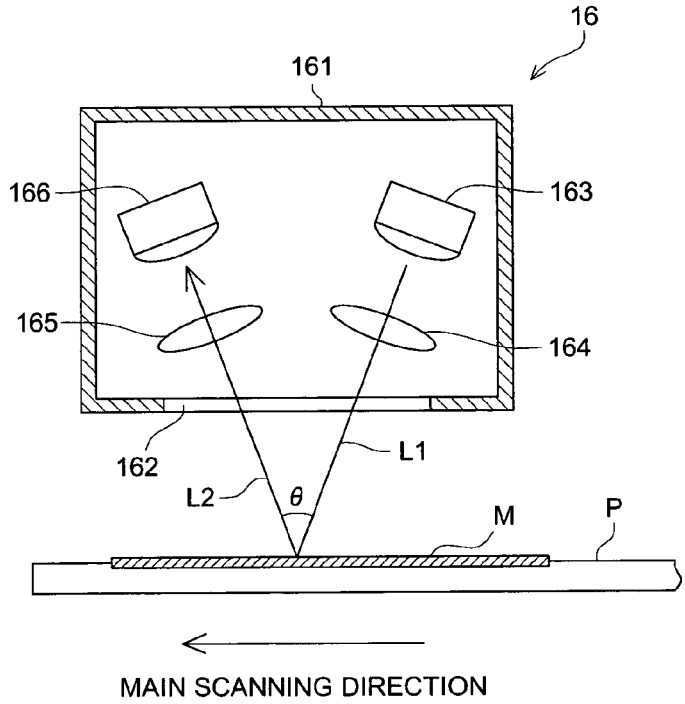
FIG. 7 is a drawing showing the alignment of the optical axis of the optical sensor observed in the sub-scanning direction.

In optical sensor 16 shown in FIG. 3, optical axes L1 and L2 of the detecting light which is emitted from light emitting element 163 and is detected by light receiving element 166 are arranged facing each other at angle θ along the sub-scanning direction, but it is not limited to this, it is also possible to be arranged at an angle to the surface of recording medium P, along the main scanning direction as shown in FIG. 7. That is, light emitting element 163 and light receiving element 166 are arranged with their optical axes L1 and L2 facing at angle θ along the main scanning direction. Since optical axes L1 and L2 of the detecting light are arranged at an angle along the main scanning direction which is perpendicular to the feeding direction of recording medium P (that is in the sub-scanning direction) as just described, the detection is rarely influenced by change of height of recording medium P in the sub-scanning direction, resulting in accurate detection having few errors, which is performed by light receiving element 166.

Next, the structure of the present invention will be described, while referring to the drawing of a block printing method shown in FIG. 4 which is one of the image recording methods. For the sake of simplicity, explained is the operation of only one head (symbol "h" is used for this head in FIG. 4) among plural heads h1–h4 in recording head H, while the recording medium is not at all illustrated in the drawing.

Figure 4:
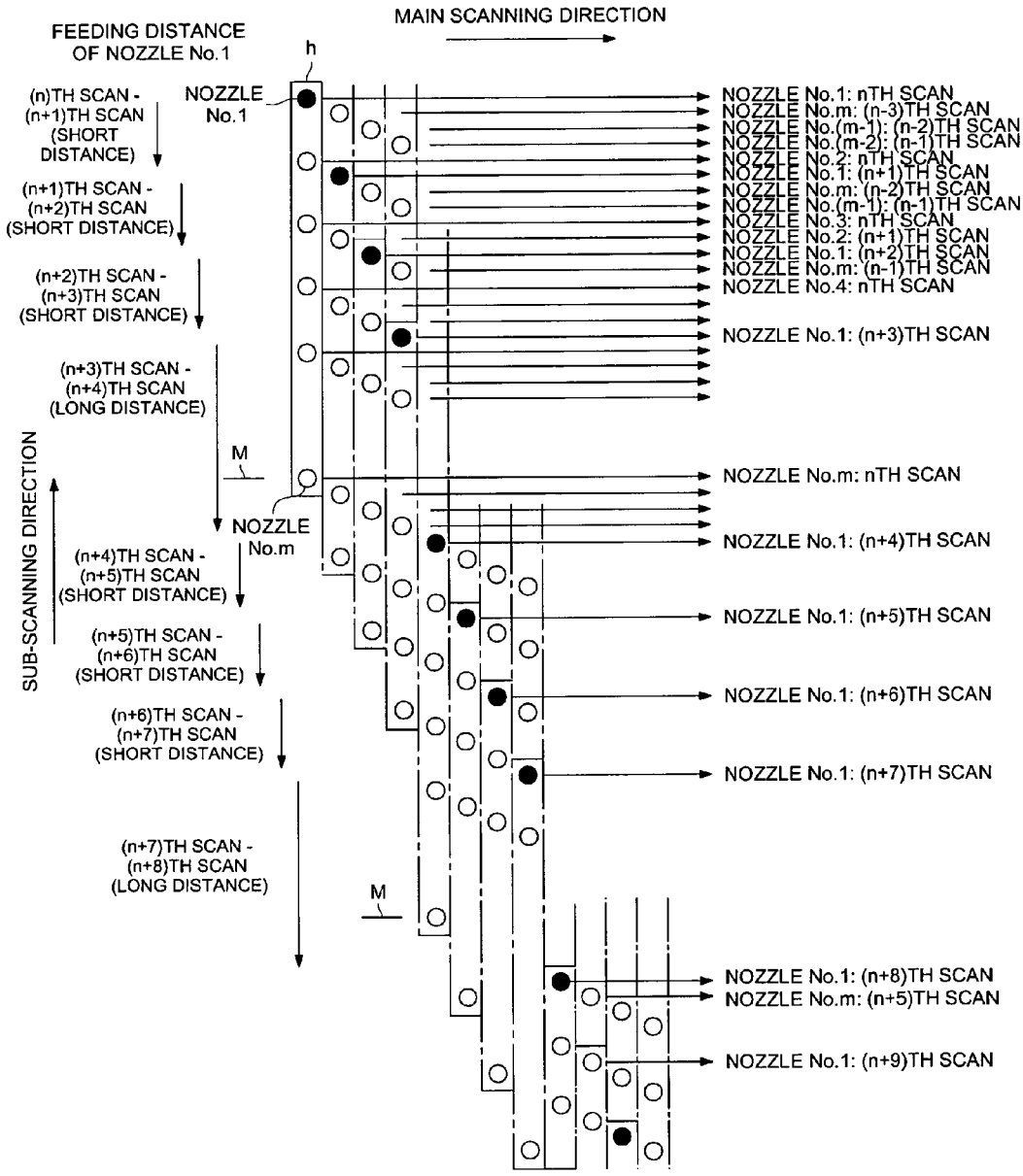
FIG. 4 is a drawing explaining an example of the block printing process.

The block printing method shown in FIG. 4 shows the method for printing one block, wherein head h having "m" nozzles including nozzles No. 1–No. m is employed, and the gap between each nozzle is filled by four scans. In this case, it is assumed that when head h is moved in the main scanning direction, that is, toward the right in FIG. 4, ink is ejected and printing is performed. In FIG. 4, nozzle No. 1 is shown by a blackened circle mark (●), while the other nozzles are shown by white circles (○).

In the $n^{th}$ scanning performed by head h, after each nozzle ejects ink and prints m lines, in order to perform the $(n+1)^{th}$ scanning of the same head h, the recording medium is fed for a prescribed distance in the sub-scanning direction by the operation of the recording medium feeding means. For convenience of explanation in FIG. 4, feeding of the recording medium is shown by feeding from the $(n)^{th}$ scanning position to the $(n+1)^{th}$ scanning position, which is in the lower right direction of head h in the figure.

In this printing method, in the $(n+1)^{th}$ scanning, recording medium is fed so that the line which is printed by nozzle No. 1 of head h is adjacent to the line which was printed by nozzle No. 2 in $(n)^{th}$ scanning, in the $(n+_2)^{th}$ scanning, recording medium is fed so that the line which is printed by nozzle No.1 of head h is brought to be adjacent to the line which was printed by nozzle No. 2 in $(n+1)^{th}$ scanning, in the $(n+3)^{th}$ scanning, recording medium is fed so that the line which is printed by nozzle No.1 of head h is brought to be adjacent to the line which was printed by nozzle No. 2 in $(n+2)^{th}$ scanning, and in the $(n+_4)^{th}$ scanning, recording medium is fed so that the line which is printed by nozzle No.1 of head h is brought to be adjacent to the line which was printed by nozzle No. 2** in $(n+3)^{th}$ scanning.

Where, for example, while the movement from the $n^{th}$ scanning to the $(n+1)^{th}$ scanning, in order to prevent the adjacent four lines, which are printed by four passes, from being printed by ink ejected from the same nozzle, and further in order to create the dispersion on errors caused by the shot declination of the ink droplet ejected from the identical nozzle, the line which is printed by nozzle No. 1 is brought to be adjacent to the line which was printed by nozzle No. 2 in the $(n)^{th}$ scanning.

By the above-mentioned four times operations (four scans), the gap between the lines printed by the $n^{th}$ scanning is completely filled, and the printing of one block is completed. The feeding distance of the recording medium during the four scanning operations is relatively short. After printing of one block is completed, the recording medium is fed to the position of $(n+4)^{th}$ scanning for head h as shown in FIG. 4, for the purpose of printing the second block in the same way as above, and the feeding distance of the recording medium is relatively long.

For example, when the four-scanning operations mentioned above are performed under the condition that the nozzles of head h consists of 128 pieces, the interval of the nozzles is 140 μm, the feeding distance of the recording medium in three of the four scans is 140+140/4=175 μm, being a short feeding distance, and every four scan, the feeding distance is (128−4)×140+140/4=17395 μm, being a long feeding distance.

In the conventional technology, the deterioration of the image quality was found to be due to a white line which was generated between the blocks by feeding errors, while the long feeding distance. However, in the present invention, since mark M is recorded in the image on the recording medium by any one of the nozzles, the recording medium is precisely fed by the after-mentioned operation. Concerning the recording of mark M, if only at least one mark M is recorded, and if mark M is recorded by a specified nozzle and at specified timing, the timing for recording mark M is effective, whenever mark M is recorded while the image is printed. FIG. 4 shows the case in which when the first scanning for printing a block is performed, straight mark M having a constant length in the main scanning direction is recorded in a non-printing area by nozzle No. m which is positioned at the rear most end in the sub directional direction in head h.

Figure 5:
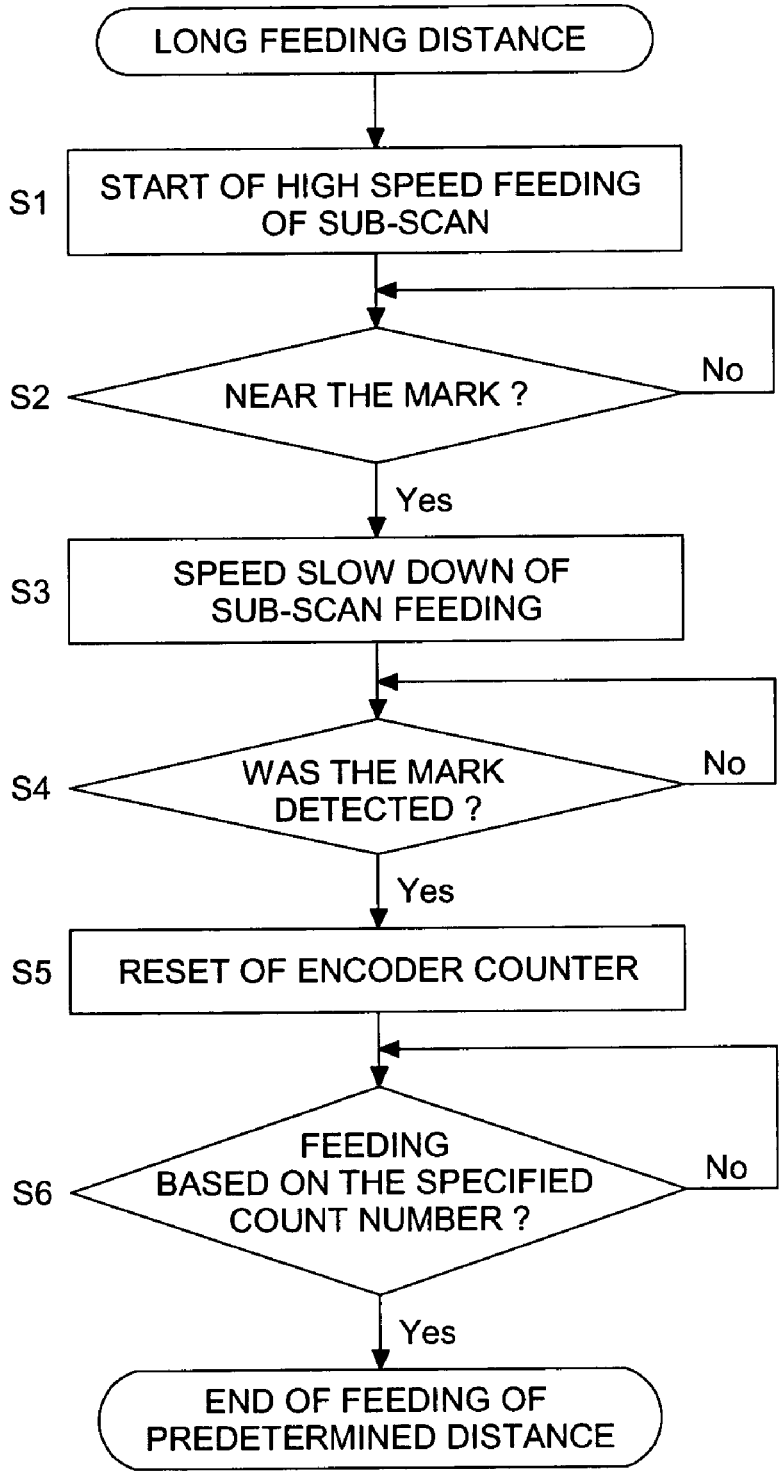
FIG. 5 is a flowchart showing the controlling operation when the recording medium advances.

FIG. 5 is a flow chart which shows, in the long distance movement, the control operation from $(n+3)^{th}$ scanning which is the final scanning while printing one block by head h, to $(n+4)^{th}$ scanning which is the first scanning for printing the following block.

Referring to this flowchart and FIGS. 1 and 4, the operation of the control will be explained.

When the printing of one block in four scannings is completed, control section 10 activates motor driver 14 to rotate sub-scanning motor 15 at a high speed, and feeds recording medium P at a high speed in the sub-scanning direction, so that the position where mark M is printed is brought to be adjacent to optical sensor 16 provided on recording head H (S 1).

In the present embodiment, as shown in FIG. 1, encoder 17 as the movement amount detecting means for detecting the movement amount of recording medium P, is provided on feeding roller R1 or R2. If mark M is recorded by the specified nozzle and at the specified timing, the position of mark P is understood ahead of time, and thereby, by counting the number of pulses generated by encoder 17 while recording medium P is fed, it is possible to recognize whether mark M is brought to be adjacent to the position where optical sensor 16 detects mark M.

By counting the number of pulses, when controller 10 detects that recording medium P has been fed adjacent to the position where mark M is detected by optical sensor 16 (S 2), in order to precisely detect mark M by optical sensor 16, control section 10 changes the rotation rate of sub-scanning motor 15 to a lower level, and feeds recording medium P at a lower speed (S 3). In the way just mentioned above, control section 10 feeds recording medium P at a high speed to the adjacent position where mark M is detected, and then changes to a low speed. Accordingly, it is possible to precisely detect mark M and to shorten the movement time, which shortens the recording time, and further it is the preferable method.

When recording medium P is fed, recording head H waits at the position where detecting light emitted from optical sensor 16 passes over mark M recorded on recording medium P (in this case, a non-printing area of recording medium P). Next, optical sensor 16 detects mark M, and the detected signal is sent to control section 10 (S4).

To detect mark M, control section 10 detects the position of mark M from the counted value of encoder 17, and resets the counted number which is the number of pulses from encoder 17 (S5), which is stored in memory section 18.

Next, control section 10 determines a reference position for feeding recording medium P for the long distance movement, based on the detected position (that is, the number of pulses from encoder 17) of the detected signal of mark M. That is, control section 10 activates motor driver 14 to drive sub-scanning motor 15, so that control section 10 feeds recording medium P in the sub-scanning direction, and newly starts to count the number of pulses generated from encoder 17 from the above-mentioned detected position. Since mark M is printed by a specified nozzle at a specified timing (In FIG. 4, when the first scanning on block 1 is performed by nozzle No. m of head h), the number of pulses is understood which can feed recording medium P from the detected position (the number of pulses from encoder 17) of mark M to the correct position at which the first scanning ($(n+4)^{th}$ scanning in FIG. 4) will be performed for printing the next block.

Since the number of pulses (that is a specified count number) for arriving at the correct position is stored in control section 10, control section 10 counts the number of pulses from encoder 17, and thereby, feeds recording medium P from the detected position of mark M to the distance which results from the specified count number (S6). The distance is constant from optical sensor 16 to the position at which mark M, actually printed on recording medium P, was detected, and further the distance is independent from the environment and mechanical errors in rollers R1 and R2, because after the distance has been adjusted, the distance is fixed by the positions of optical sensor 16 and the printed position of mark M. Accordingly, even though recording medium P is fed in the sub-scanning direction for the long distance which is nearly equal to the length of the head, only small movement errors occur, and thereby, feeding errors in the course of the long distance movement can be drastically reduced. Therefore, when recording head H starts printing for the next block, recording head H can print the images without a white line between the leading block and the next block.

When mark M is not recorded on recording medium P for any reasons, or when mark M disappears though it was recorded, it occasionally happens that optical sensor 16 can not normally detect mark M in step S4, though recording medium P is fed to the position at which mark M should be detected. However, control section 10 is designed to feed recording medium P based on the previous movement amounts. That is, the number of pulses of encoder 17 until the detection of mark M is stored in memory section 18 as mentioned above, it is possible to retrieve the movement amounts from the cases of the previous movements which are the long distance movements of recording medium P, by the stored number of pulses and the above-mentioned specified count number. Accordingly, even when mark M is not detected as normal, control section 10 can feed recording medium P without large errors, by controlling motor driver 14 and sub-scanning motor 15, based on the movement amounts in the cases of the previous movements.

Further, it may be preferable that the movement distance in the sub-scanning direction of recording medium P, which is the distance until optical sensor 16 detects mark M printed on recording medium P, is shorter than the movement amount in the sub-scanning direction, that is, in the case of the above-mentioned block printing, the movement amount for the long distance movement to perform printing for the next block. Due to this, when optical sensor 16 detects mark M printed on recording medium P, the detection of mark M is performed in a direction along the sub-scanning direction, therefore, the detecting accuracy is increased.

In the above-mentioned explanation, when recording medium P is fed for the long distance in the sub-scanning direction, optical sensor 16 detects mark M printed on recording medium P, and then the movement amount of recording medium P, fed by the recording medium feeding means, is determined based on the detected position of the detected signal, or more specifically, it is preferable to switch to the case wherein, by counting pulses from encoder 17 shown in FIG. 1 for feeding recording medium P in the sub-scanning direction, the movement amount of recording medium P, fed by the recording medium feeding means, is determined based on only the counted number of pulses.

For the purpose of the above case, controller 10 is provided with a switching means for switching the determining methods of the movement amount of recording medium P by the recording medium feeding means. For example, in the case of recording of a higher image quality with minimum streaking, the movement amount is determined based on the position of the detector when the detector detects mark M, while in the case that high speed printing is performed so that printing rate has priority over image quality, the movement amount is determined based on only the counted number of pulses from encoder 17. In the first case, recording medium P can be fed with high feeding accuracy, and in the second case, the feeding time of recording medium P is shortened and the high speed feeding can be attained.

It is further preferable to simultaneously record plural marks M on recording medium P which are formed by ink droplets ejected from plural nozzles. Generally, the nozzles of the recording head are designed on the assumption that the ink droplet is straightly ejected from each nozzle, and the pitch of the nozzles are fixed so that the nozzles are arranged at regular intervals. However in actual manufacturing of recording heads, the form of the nozzles, the ink jetting speed from each nozzle, and the jetting angles are slightly different. Therefore the ink droplets are ejected onto recording medium P slightly away from the regular position. When such nozzles result in misalignment of impact areas are employed to print mark M, and further when the long distance movement of the recording medium is performed based on the position of the sensor when the sensor detects a mark, such mark M, as mentioned above, errors may occur. Still further, the simultaneous recording of plural marks M on recording medium P by plural different nozzles also decrease the occurrence of errors, resulting in a further degree of feeding accuracy.

Figure 6:
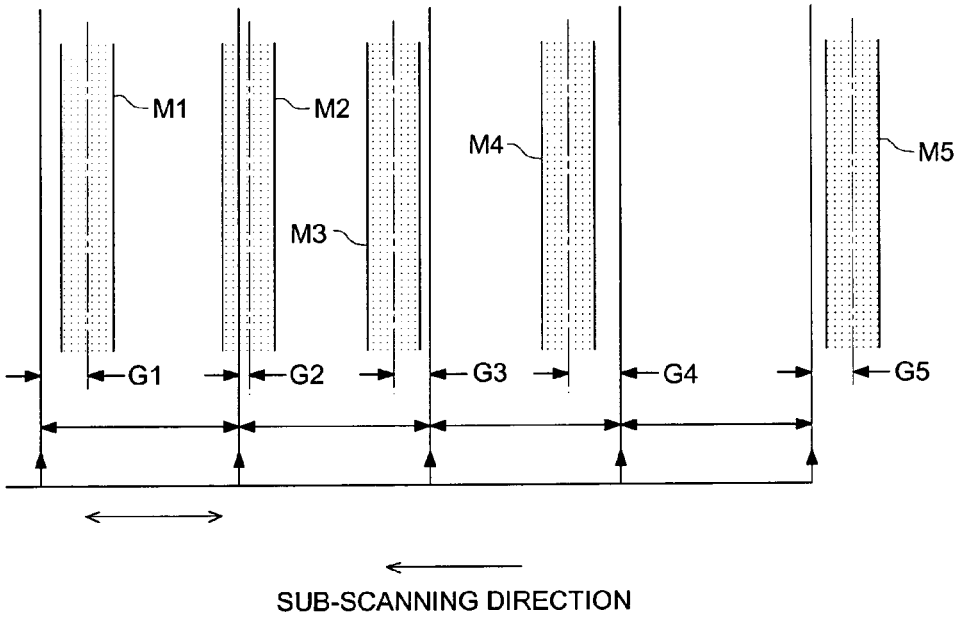
FIG. 6 is a drawing explaining the operation when plural marks are printed.

This example will be explained further, while using FIG. 6, which shows the case wherein adjacent five nozzles simultaneously eject ink droplets, and five straight marks M1–M5 are recorded. The pitch of marks M1–M5 shall be naturally equal to the design value of the pitch of the adjacent five nozzles. In FIG. 6, the solid line shows an assumed position on which the five marks are recorded which are calculated from the designed value of the nozzle pitch. The assumed positions are aligned at the distance where the pitch of the nozzles is equal. However, actual marks M1–M5 are aligned with different pitches, due to the misalignment of the impact areas of the ink droplets of each nozzle. In this case, the above-mentioned assumed positions shown by the solid lines are only processed in control section 10 shown in FIG. 1, and are not actually shown on recording medium P.

As shown in FIG. 1, optical sensor 16 provided on recording head H detects in turn the positions of marks M1–M5 recorded on recording medium P, by the movement of recording medium P in the sub-scanning direction. In FIG. 6, the detected positions of marks M1–M5 detected by optical sensor 16 are shown by the alternating long and short dashed lines.

Control section 10 in FIG. 1 detects errors G1–G5 between the above-mentioned assumed positions and the actual detected positions. Errors G1–G5 are detected as positive or negative errors, based on the positions to the assumed positions in the sub-scanning direction. For example, in FIG. 6, errors G1, G2, and G5 have positive error amounts, while errors G3 and G4 have negative error amounts.

Next, control section 10 calculates the sum of errors G1–G5, and presumes the position of the assumed position. Then, obtained is the position wherein the detection error between the detected position and the assumed position which is distance interval calculated by the nozzle pitch. Control section 10 determines the movement amount of recording medium P, based on the assumed position which was calculated and presumed, and further, control section 10 controls motor driver 14 to activate sub-scanning motor 15, and thus feeds recording medium P. Therefore, the errors of the detected position of mark M due to the difference of nozzles of the recording head, is controlled to be minimal so that it is possible to feed recording medium P very precisely.

In the above explanation, mark M is printed on the non-printing image area which is out of the image printing area on recording medium P. However, in case of producing "a borderless image", which is a print with images printed on a total area of recording medium P, it is not possible to use the above-mentioned example wherein mark M is printed on the non-printing image area and where mark M is detected, because the total area of recording medium P is image printing area. Therefore, when borderless image is produced, it is preferable that mark M is recorded at an up-stream location in the feeding direction of the recording medium P rather than in an area on which recording will be performed by main scanning of recording head H.

The up-stream location in the feeding direction of recording medium P, rather than an area on which recording will be performed by main scanning of recording head H, is an area on which recording has not yet been performed, and thereby if mark M is recorded on this area and after that recording medium P is fed in the sub-scanning direction, this mark M will be detected when optical sensor 16 passes above mark M. Further, when images are recorded by the main scanning conducted by recording head H, above-mentioned mark M is hidden by images so that mark M is rarely observed.

A structure of recording head H which is preferable for the case wherein mark M is recorded on the upper-stream side in the feeding direction of recording medium P rather than the area on which the images are recorded by the main scanning of recording head H, will be explained, while referring to FIG. 8. For the numerals the same as in the case of FIG. 8 showing the same structure as FIG. 1, the explanation will be omitted.

Figure 8:
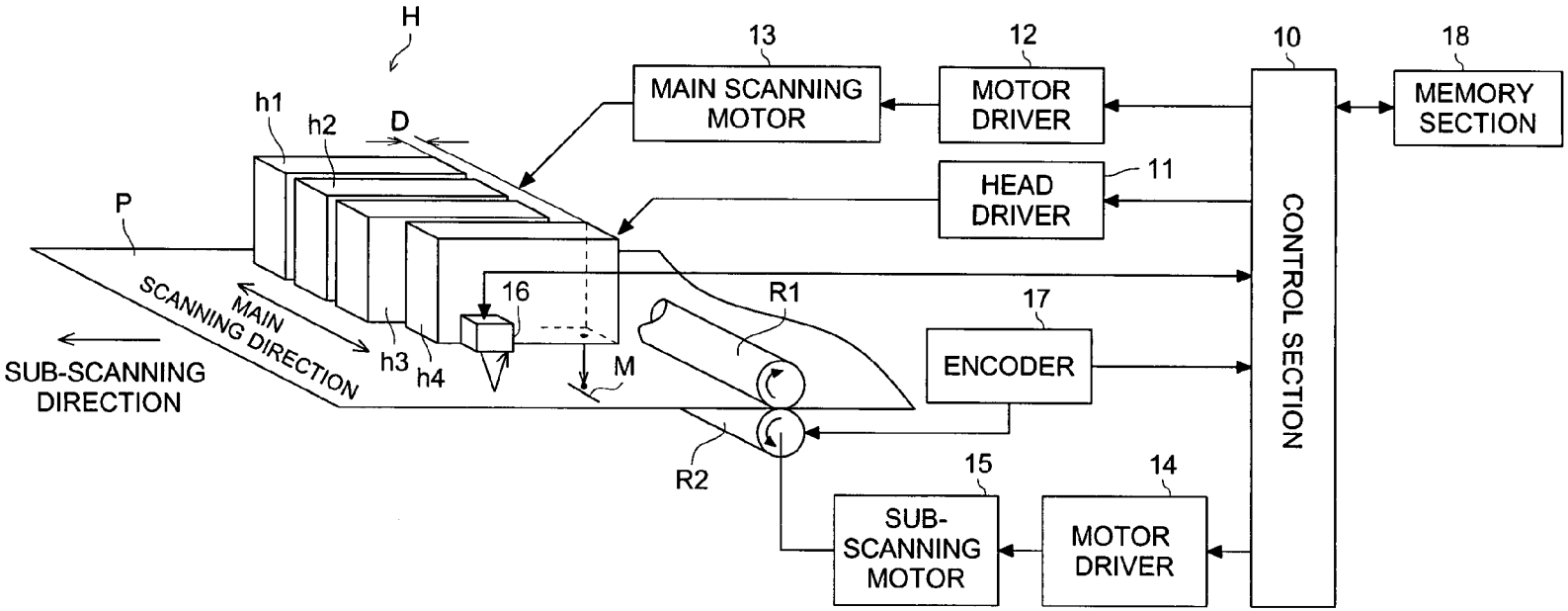
FIG. 8 is a schematic drawing showing the other embodiment of the inkjet recording apparatus relating to the present invention.

As shown in FIG. 8, among four heads h1–h4 of recording head H, a head (head h4 in this case, but not limited to h4) having a nozzle for recording mark M on recording medium P by jetting ink, is shifted from other heads h1–h3 by a predetermined length (D), in the feeding direction (that is, the sub-scanning direction) of recording medium P. The larger this shift amount D is, the greater the overheads (that is, a not printed area) is at the writing start and the writing end, resulting in a bad influence on a printing time, therefore, shift amount D is larger than one nozzle width of head h1 for recording mark M, and more preferably, larger than one nozzle width and smaller than N/5 nozzle width. In this case, N means the number of nozzles per head.

As mentioned above, head h4 having a nozzle for recording mark M among recording head H, is shifted from the other heads h1–h3, more than one nozzle width up-stream in the feeding direction of recording medium P, and thereby, head h4 previously records mark M which precedes shift amount D, up-stream of the feeding direction of recording medium P. Since the area on which mark M is previously recorded is the area on which recording has not yet been performed on recording medium P, mark M can be detected by optical sensor 16, when recording medium P is fed in the sub-scanning direction. After that, recording head H performs the main scanning to print the images, and mark M having been recorded on recording medium P is covered by the subsequent images.

As mentioned above, the area on which mark M is recorded is in the image area of "the borderless image". Though mark M is subsequently covered by images produced by the main scanning of recording head H, mark M should be recorded in an area small enough to be detected by optical sensor 16, to prevent as far as possible any negative influence on the images. In order to record mark M in an extremely small area, it is preferable that data corresponding to the nozzle for recording mark M is controlled and changed to 1 (the ink jetting system is ON) for a distance enough to record mark M in the main scanning direction. Specifically, it is preferable that mark M which is used when "the borderless images" is recorded, is formed in a single straight line recorded by the ink jet from a single nozzle, and the single straight line can be recorded in an extremely small area.

Further, in order to clearly discriminate mark M from the images, and to make mark M detectable by optical sensor 16, it is preferable that the nozzles adjacent to the nozzle for recording mark M are controlled to be "zero filling with ink", which means non-ejection of ink.

In the case that a plurality of marks M are recorded for the purpose of obtaining high accuracy feeding, as stated above, it is preferable that a spot diameter of the detecting light from optical sensor 16 is smaller than the interval between each mark M in the sub-scanning direction, and that the data corresponding to the nozzles for recording marks M are changed to be 1 (the ink jetting system is ON) for the distance necessary for recording marks M in the main scanning direction. Thereby, marks M are recorded in such an extremely small area that a plurality of marks M can be precisely detected by the detecting beam.

The control of these nozzles is performed by control section 10 (shown in FIG. 1).

By the way, in optical sensor 16 which is represented by a reflection type sensor, the detecting light emitted from light emitting element 163 passes through condenser lens 164, and is incident to the surface of recording medium P at an angle, then the reflected light passes through condenser lens 165 and enters light receiving element 166. That is, both optical axis L1 of the detecting light emitted from light emitting element 163 to recording medium P and optical axis L2 of the reflected light reflected from recording medium P, to light receiving element 166, face each other at angle θ.

When ink has been jetted onto recording medium P, it sometimes happens that recording medium P gets winkles, or moves up to recording head H by an air gap between recording medium P and a platen on which recording medium P lies. If the surface of recording medium P is not flat, the light flux reflected from the surface of recording medium P cannot be precisely received by light receiving element 166, which results in detection errors.

The following explanation is about optical sensor 16 which can precisely detect mark M, even when the surface of recording medium P changes in height.

In optical sensor 16 for this purpose, optical axes L1 and L2 of the detecting light are arranged nearly perpendicular to the surface of recording medium P. Since optical axes L1 and L2 are arranged nearly perpendicular to the surface of recording medium P, though recording medium P changes in height, a major change of the receiving position of the detecting light does not occur in the sub-scanning direction, therefore, there is no great influence upon the detecting accuracy, which can still accurately detect mark M.

"Nearly perpendicular" means a range of ±10° in the angle formed by optical axis L1 of the detecting light emitted from the light emitting element to the surface of recording medium P, and optical axis L2 of the detecting light reflected on the surface of recording medium P to the light receiving element.

Optical sensor 16 mentioned above will be explained, while referring to FIGS. 9–11.

Figure 9:
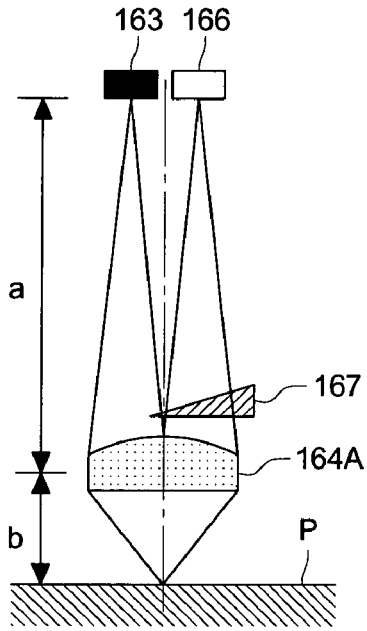
FIG. 9 is a drawing showing another example of the optical sensor.

In FIG. 9, light emitting element 163 and light receiving element 166, which are adjacent to each other, are arranged nearly parallel to the surface of recording medium P. The detecting light emitted from light emitting element 163 passes through condenser lens 164A and is incident almost perpendicularly to the surface of recording medium P. Wedge lens 167 is arranged between condenser lens 164A and light receiving element 166, and wedge lens 167 partially regulates the detecting light which is reflected from the surface of recording medium P and enters light receiving element 166 through condenser lens 164A. That is, the detecting light which is almost perpendicularly reflected from the surface of recording medium P, passes through condenser lens 164A, then passes through wedge lens 167, and is incident to light receiving element 166 which takes a place beside light emitting element 163.

Figure 10:
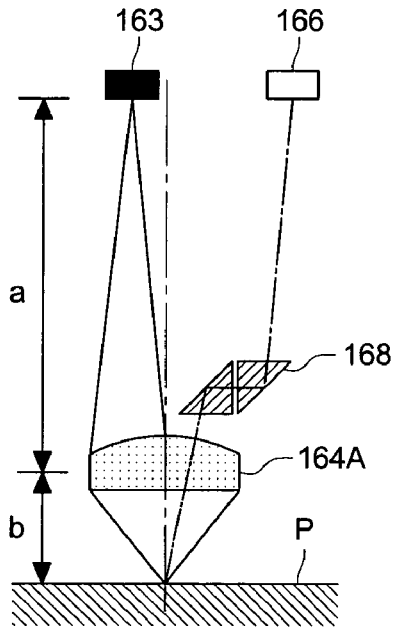
FIG. 10 is a drawing showing another example of the optical sensor.

FIG. 10 shows an example in which prisms 168 are used instead of wedge lens 167 in FIG. 9. In this case, the detecting light is emitted from light emitting element 163, passes through condenser lens 164A, and is incident almost perpendicularly to the surface of recording medium P. The detecting light is reflected on the surface of recording medium P, passes through condenser lens 164A and is partially regulated by prisms 168, and enters light receiving element 166 which is installed beside light emitting element 163.

In the above-explained example, since light receiving element 166 take a place beside light emitting element 163, it is possible to optionally set the reflected light receiving position by the structure of prisms 168, which is a merit, and thereby light receiving element 166 can be arranged over a wider range.

Figure 11:
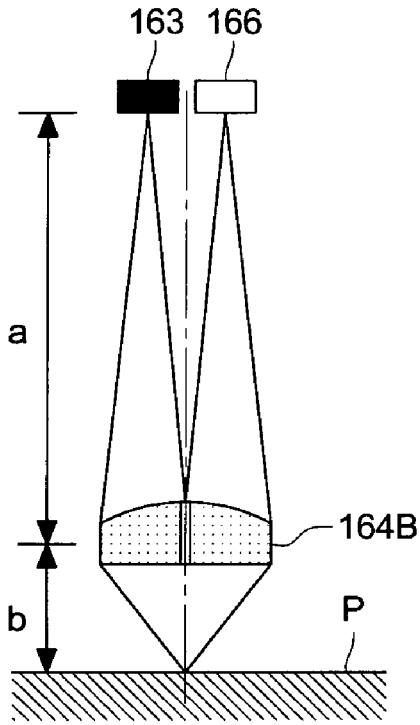
FIG. 11(*a*) is a drawing showing another example of the optical sensor, and FIG. 11(*b*) is a drawing showing the condenser lens of that optical sensor.
Figure 11:
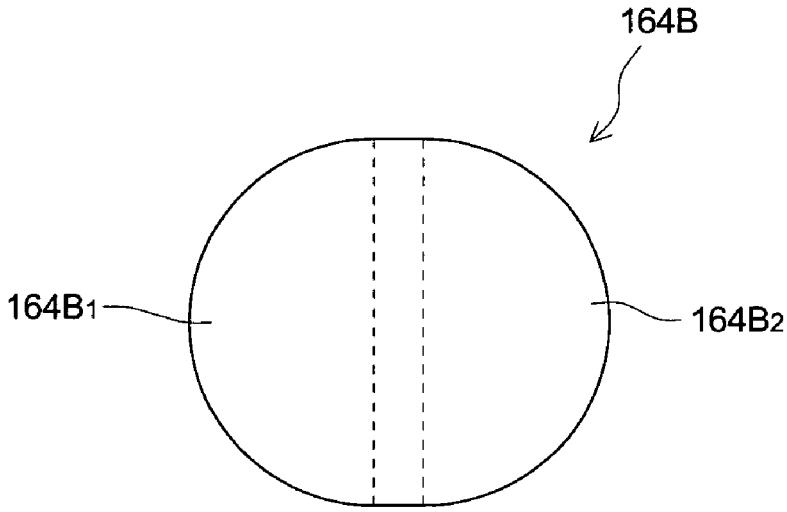

In FIG. 11(*a*), condenser lens 164B is commonly used for light emitting element 163 and light receiving element 166. This condenser lens 164B is, as shown in FIG. 11(*b*), formed into area 164$B_1$ for focusing the light flux emitted from light emitting element 163 onto the surface of recording medium P, and area 164$B_2$ for focusing the light flux reflected from the surface of recording medium P onto light receiving element 166. FIG. 11(*b*) is a top view of condenser lens 164B.

Accordingly, the detecting light emitted from light emitting element 163 is almost perpendicularly focused onto the surface of recording medium P by area 164$B_1$ of condenser lens 164B. The light almost perpendicularly reflected from the surface of recording medium P, is focused onto light receiving element 166, which takes is located beside light emitting element 163, by area 164$B_2$ of condenser lens 164B.

According to this example, by employing a single condenser lens 164B, it is possible to arrange the optical axis of the detecting light, which is emitted from light emitting element 163 to the recording surface of recording medium P, almost perpendicularly to recording medium P, and thereby the structure of optical sensor 16 can be simplified.

In the case that optical sensor 16, which is arranged so that optical axes L1 and L2 of detecting light are almost perpendicular to the surface of recording medium P, is employed for the mark detecting means, when plural marks M are recorded at one time on recording medium P by the ink jetting from plural different nozzles, it is preferable that the arrangement of light emitting element 163, condenser lens 164A and 164B, and recording medium P, satisfies the condition of $k \times b < a \times m$, where "k" is the length of light emitting element 163 in the sub-scanning direction, "a" is the distance between light emitting element 163 and condenser lens 164A and 164B, "b" is the distance between condenser lens 164A and 164B and the surface of recording medium P, and "m" is the pitch of marks M in the sub-scanning direction (see FIGS. 9–11).

By satisfying the above condition, the spot diameter of the detecting light is smaller than the pitch of marks M in the sub-scanning direction, and it is possible to decrease the level of signals of detecting light, between marks M to be detected. Accordingly, it is possible to obviously distinguish between the detecting sections of mark M and non-detecting sections of mark M, and thereby to accurately detect a plurality of marks M.

According to structure 1, it is possible to provide an ink jet recording apparatus wherein the recording medium can be accurately fed, even when the recording medium is fed for the long distance in the sub-scanning direction.

According to structure 2, the recording medium is fed at a relatively high speed to a position which is adjacent to the position where the mark is detected, and further it is fed at a lower speed when it comes near the position for mark detection, therefore the mark can be detected accurately and the feeding time is reduced, that is, the overall recording time can be reduced.

According to structure 3, even when the mark cannot be detected, the recording medium is fed on the basis of the previous amount of movement so that the recording medium can be fed without large errors.

According to structure 4, the detection of mark M recorded on the recording medium is performed in a direction along the sub-scanning direction so that the detecting accuracy can be increased.

According to structure 5, it is possible to select a case in which the recording medium is fed with high accuracy, or a case in which the movement time of the recording medium is shortened for the purpose of high speed processing, based on the using condition, and accordingly, an inkjet recording apparatus with high usability can be provided.

According to structure 6, the number of parts is reduced so that the cost can be further reduced.

According to structure 7, since it is possible to control errors of the detecting position of the mark, caused by differences of each nozzle of the recording head, to a minimum level, the recording medium can be fed at a high degree of accuracy.

According to structure 8, the mark recorded on the recording medium does not influence the images.

According to structure 9, even in the case of borderless printing wherein the images are printed with no margins on the recording medium, the detection mark on the recording medium can still be detected.

According to structure 10, even in the case of borderless printing wherein the images are printed with no margins on the recording medium, the detection mark can be recorded on a not-yet printed area of the recording medium.

According to structure 11, it is possible to record the mark on an extremely small area which can still be detected by the mark detecting means, and also control any adverse influence by the mark upon the images to be printed as much as possible.

According to structure 12, since the mark is clearly distinguished from the images, the mark can be assuredly detected by the mark detecting means.

According to structure 13, since the change of the height of the surface of the recording medium rarely influences the detection of the mark, the mark can be assuredly detected with fewer errors.

According to structure 14, even when the height of the surface of the recording medium changes, the position where the light is detected does not change significantly, therefore, the mark detecting accuracy is barely influenced, and accurate detection of the mark is performed.

According to structure 15, the spot diameter of the detecting light beam is smaller than the pitch of the marks in the sub-scanning direction, and it is possible to decrease the level of signals of the detecting light beam, between the plural marks to be detected. Accordingly, it is possible to easily distinguish between the detecting sections of the marks and the non-detecting sections of the marks, and thereby, it is possible to accurately detect the plurality of the marks.

According to structure 16, it is possible to make the mark recorded on the recording medium invisible.

According to structure 17, the mark recorded by an invisible yellow ink can be easily detected.

According to structure 18, only one scan by the recording head can easily record the mark, which the mark detecting means can accurately detect, and therefore, the movement of the recording medium can be performed with higher accuracy.

What is claimed is:

1. An inkjet recording apparatus, comprising:

a recording medium feeding section to feed a recording medium on a platen;

a recording head including a plurality of nozzles to eject ink droplets onto the recording medium;

a recording head moving section to move the recording head in a direction perpendicular to a feeding direction of the recording medium;

a mark recording section to record a plurality of marks, which are perpendicular to the feeding direction of the recording medium, on the recording medium using a plurality of the nozzles, while the recording head is moved by the recording head moving section; and a mark detecting unit which is moved together with the recording head and detects the plurality of marks;

wherein the recording medium feeding section calculates and assumes a position which gives a smallest detection error from a distance interval calculated by a nozzle pitch of the recording head, referring to a position of each mark detected by the mark detecting unit; and wherein a feeding amount of the recording medium is determined based on the calculated and assumed position; and wherein the mark detecting unit comprises a light reflection type sensor, which includes:

a light emitting element which emits detecting light onto a recording medium;

a condenser lens which condenses detecting light emitted from the light emitting element; and a light receiving sensor which detects light reflected from a surface of the recording medium on which the detecting light is focused by the condenser lens, wherein an optical axis of the light emitting element and an optical axis of the condenser lens are approximately perpendicular to the surface of the recording medium, and wherein the light emitting element, the condenser lens and the recording medium are arranged so as to satisfy an inequality $k \times b < a \times m$, where:

k is a length of the light emitting element in a sub-scanning direction, a is a distance between the condenser lens and the surface of the recording medium, b is a distance between the condenser lens and the surface of recording medium, and m is a pitch of the plurality of marks in the sub-scanning direction.

* * * * *